US007775620B2

(12) United States Patent
Furukawa

(10) Patent No.: US 7,775,620 B2
(45) Date of Patent: Aug. 17, 2010

(54) SUBSTRATE FOR INK JET RECORDING HEAD, DRIVING CONTROL METHOD, INK JET RECORDING HEAD, AND INK JET RECORDING APPARATUS

(75) Inventor: Tatsuo Furukawa, Zama (JP)

(73) Assignee: Canon Kabushiki Kaisha, Tokyo (JP)

( * ) Notice: Subject to any disclaimer, the term of this patent is extended or adjusted under 35 U.S.C. 154(b) by 592 days.

(21) Appl. No.: 11/291,953

(22) Filed: Dec. 2, 2005

(65) Prior Publication Data

US 2006/0125871 A1 Jun. 15, 2006

(30) Foreign Application Priority Data

Dec. 9, 2004 (JP) ..... 2004-357185

(51) Int. Cl.
*B41J 2/015* (2006.01)
*B41J 2/14* (2006.01)
*B41J 29/38* (2006.01)

(52) U.S. Cl. ..... 347/20; 347/9; 347/50

(58) Field of Classification Search ..... 347/5, 347/9–12, 20, 50
See application file for complete search history.

(56) References Cited

U.S. PATENT DOCUMENTS 6,290,334 B1 9/2001 Ishinaga et al.
6,302,504 B1 * 10/2001 Imanaka et al. ..... 347/9
6,474,782 B1 * 11/2002 Furukawa ..... 347/50
6,971,735 B2 12/2005 Saito et al.
2005/0225578 A1 * 10/2005 Hu et al. ..... 347/9
2006/0139412 A1 6/2006 Sakurai et al.
2006/0209131 A1 9/2006 Furukawa

FOREIGN PATENT DOCUMENTS

JP 2-6138 A 1/1990
JP 5-185594 A 7/1993
JP 10138484 A 5/1998

* cited by examiner

*Primary Examiner*—Julian D Huffman
*Assistant Examiner*—Jason S Uhlenhake
(74) *Attorney, Agent, or Firm*—Fitzpatrick, Cella, Harper & Scinto

(57) ABSTRACT

A substrate for an ink jet recording head, the substrate provided with an electrothermal transducer for generating thermal energy used for discharging ink and a driving circuit for driving the electrothermal transducer, the substrate having a logical circuit for outputting, at a second voltage amplitude level based on an input signal of a first voltage amplitude level, a selection signal for designating the electrothermal transducer to be driven, a driving circuit for driving the electrothermal transducer based on the selection signal from the logical circuit in units of blocks, and a buffer circuit which has current supply capability enabling gates fed with one selection signal to be all driven in the driving circuit and relays the selection signal between the logical circuit and the driving circuit.

10 Claims, 14 Drawing Sheets

SUBSTRATE FOR INK JET RECORDING HEAD, DRIVING CONTROL METHOD, INK JET RECORDING HEAD, AND INK JET RECORDING APPARATUS

FIELD OF THE INVENTION

The present invention relates to a substrate for an ink jet recording head, an ink jet recording head, and a recording apparatus using the recording head, and particularly relates to an ink jet recording head in which an electrothermal transducer for generating thermal energy required for discharging ink and a driving circuit for driving the electrothermal transducer are formed on the same substrate, and a recording apparatus using the recording head.

BACKGROUND OF THE INVENTION

Generally, the electrothermal transducer (heater) of a recording head mounted in a recording apparatus conforming to ink jet method and the driving circuit of the electrothermal transducer are formed on the same substrate by semiconductor process technology as disclosed in, for example, the specification of U.S. Pat. No. 6,290,334. Further, a recording head is proposed in which a digital circuit or the like for detecting a state of such a semiconductor substrate, e.g., a substrate temperature is formed on the same substrate in addition to the driving circuit, an ink supply port is disposed around the center of the substrate, and heaters are opposed to each other with the ink supply port interposed therebetween.

FIG. 6 is a diagram schematically showing the semiconductor substrate for such an ink jet recording head, namely, a semiconductor substrate for an ink jet recording head including a circuit for outputting a digital signal for detecting a temperature.

In FIG. 6, reference numeral 500 denotes a substrate where heaters and driving circuits are integrally formed by semiconductor process technology. Reference numeral 501 denotes a heater/driver array in which two or more heaters and driver circuits are arranged. Reference numeral 502 denotes ink supply ports for supplying ink from the backside of the substrate.

Reference numeral 503 denotes shift registers for temporarily storing print data to be recorded. Reference numeral 507 denotes decoder circuits each of which outputs a heater block selection signal for driving the heaters in the heater/driver array 501 for each heater block. Reference numeral 504 denotes input circuits each including a buffer circuit for inputting a digital signal to the shift register 503 and the decoder 507. Reference numeral 510 denotes input terminals including a terminal for supplying a logic device voltage Vdd, a terminal CLK for inputting a clock signal, and a terminal for inputting data such as print data.

FIG. 8 is a timing chart for explaining a series of operations of the transmission of print information to the shift register 503, the supply of current to the heater, and the driving of the heater.

Print data is supplied to DATA_A and DATA_B terminals in synchronization with a clock pulse inputted to the CLK terminal. The shift register 503 temporarily stores the supplied print data and a latch circuit stores the print data in response to a latch signal applied to a BG terminal. Thereafter, a block selection signal for selecting a heater group divided into desired blocks and the print data (device selection signal) having been stored in response to the latch signal are ANDed in a matrix manner, and heater current is applied in synchronization with an HE signal for directly determining a current driving time. The series of operations is repeated for each block to perform printing.

FIG. 7A is an equivalent circuit diagram showing one segment for supplying current to the heater for discharging ink. FIG. 7B is an equivalent circuit diagram corresponding to 1 bit in the shift register and the latch circuit which temporarily store image data to be printed.

The block selection signal inputted to an AND circuit 601 is transmitted from the decoder circuit 507 in order to select a heater group divided into timing blocks which can be driven with almost the same timing. The device selection signal inputted to the AND circuit 601 is based on an image signal which is transferred to the shift register 503 and then stored in response to the latch signal. In order to selectively turn on each segment according to print data, the block selection signal and the device selection signal are ANDed in a matrix manner by the AND circuit 601.

Reference numeral 605 denotes a VH power supply line serving as a power supply for driving the heater, reference numeral 606 denotes the heater, and reference numeral 607 denotes a driver transistor for passing current through the heater 606. Reference numeral 602 denotes an inverter circuit acting as a buffer in response to the output of the AND circuit 601. Reference numeral 603 denotes a VDD power supply line serving as the power supply of the inverter circuit 602. Reference numeral 608 denotes an inverter circuit acting as a buffer for receiving the buffer output of the inverter circuit 602. Reference numeral 604 denotes a VHT power supply line which acts as a power supply for supplying power to the buffer including the inverter circuit 608 and supplying the gate voltage of the driver transistor.

Generally, the inverter 602 and the shift register 503 or the like are digital circuits and are basically operated by a Lo/Hi pulse. Further, the interface of the original print information of the recording head and an applied pulse for driving the heater are also digital signals, and the signals are transmitted and received to and from the outside by a Lo/Hi logic pulse. These logic pulses generally have an amplitude of 0 V/5 V or 0 V/3.3 V. A power supply VDD of the digital circuit is supplied by one of these voltages. Therefore, a pulse having an amplitude of a VDD voltage is inputted to the AND circuit 601, passes through a buffer comprising the two-stage inverter circuit 602, and is inputted to the inverter circuit 608 of the subsequent stage.

The inverter circuit 608 of the subsequent stage is also a logical circuit but operates at a higher voltage than the inverter 602 of the previous stage.

It is preferable that the driver transistor 607 has a low resistance, that is, a low on-resistance in an on state. This is because power consumed by a part other than the heater is minimized, which makes it possible to prevent an increase in substrate temperature and stably drive the recording head. In the case where the driver transistor 607 has a high on-resistance, a voltage drop caused by the passage of heater current through this part increases and an excessively high voltage has to be applied to the heater, resulting in excessive power consumption.

In order to reduce the on-resistance of the driver transistor 607, a voltage applied to the gate of the driver transistor 607 has to be set high. For this purpose, the circuit of FIG. 7A requires a circuit for conversion into a pulse having an amplitude of a voltage higher than the voltage VDD. Thus, in the circuit of FIG. 7A, the power supply line 604 of a voltage VHT higher than the voltage VDD is prepared. A segment selection signal (a signal for selectively driving heaters) having been inputted by a pulse having an amplitude of the VDD voltage is converted into a pulse having an amplitude of the voltage VHT by a buffer circuit including the inverter circuit 608. After the conversion into the pulse having the amplitude of the voltage VHT, the pulse is applied to the gate of the driver transistor 607. In other words, as shown in FIG. 7A, signals are transmitted and received to and from the outside, and signal processing in the internal digital circuit is performed by the pulse having the amplitude of the voltage VDD (voltage for driving a logical circuit). Moreover, a circuit (pulse amplitude converter circuit) is added to each segment. The circuit converts the signal into the pulse having the amplitude of the voltage VHT (voltage for driving a device) immediately before the gate of the driver transistor 607 is driven.

Generally, the recording head has a plurality of segments arranged with a high density. Thus, for example, when the segments are arranged with a density of 600 dpi, the width of the segment is limited to about 42.3 μm in the arrangement direction. In the case where the circuits of FIG. 7A for driving the segments are all stored in this pitch, each of the segments requires a large area corresponding to the number of devices in a direction perpendicular to the arrangement direction. The area is larger than that of a configuration having a lower density of arrangement.

FIG. 9 is an equivalent circuit diagram showing a specific configuration of the pulse amplitude converter circuit of FIG. 7A. As shown in FIG. 9, the pulse amplitude converter circuit, particularly a level conversion part indicated by a dotted line comprises a number of transistors, which requires a large chip area.

In the case of the layout of the substrate for the recording head configured thus, the pulse amplitude converter circuit added for each segment increases the length of each segment, thereby increasing a chip size and cost. To be specific, in the foregoing layout, a chip expands in a direction perpendicular to a segment array and thus the chip considerably increases in size. Further, when a pulse amplitude converter circuit is added to each segment, for example, in the case of a recording head with 256 segments, the necessary number of buffer circuits is equivalent to at least 256 inverters. This configuration reduces yields and complicates a circuit configuration, thereby increasing cost.

SUMMARY OF THE INVENTION

The present invention is devised in view of the problems. An object of the present invention is to provide a circuit configuration for converting a logic driving voltage to a device driving voltage without increasing a length in a direction perpendicular to the arrangement direction of each segment, and reduce rounding of pulse edges in a pulse amplitude converter circuit so as to improve an ink discharging property.

Another object of the present invention is to improve yields and simplify the circuit configuration by reducing the pulse amplitude converter circuit and the number of devices formed on a substrate.

According to one aspect of the present invention, the substrate for the ink jet recording head for attaining the objects is configured as follows:

the substrate for the ink jet recording head, the substrate provided with an electrothermal transducer for generating thermal energy used for discharging ink and a driving circuit for driving the electrothermal transducer, the substrate comprising:

a logical circuit for outputting, at a second voltage amplitude level based on an input signal of a first voltage amplitude level, a selection signal for designating the electrothermal transducer to be driven, a driving circuit for driving the electrothermal transducer based on the selection signal from the logical circuit in units of blocks, and a buffer circuit which has current supply capability of driving all gates fed with one selection signal in the driving circuit and relays the selection signal between the logical circuit and the driving circuit.

Further, the present invention provides an ink jet recording head using the substrate for an ink jet recording head, and an ink jet recording apparatus using the ink jet recording head.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Figure 1:
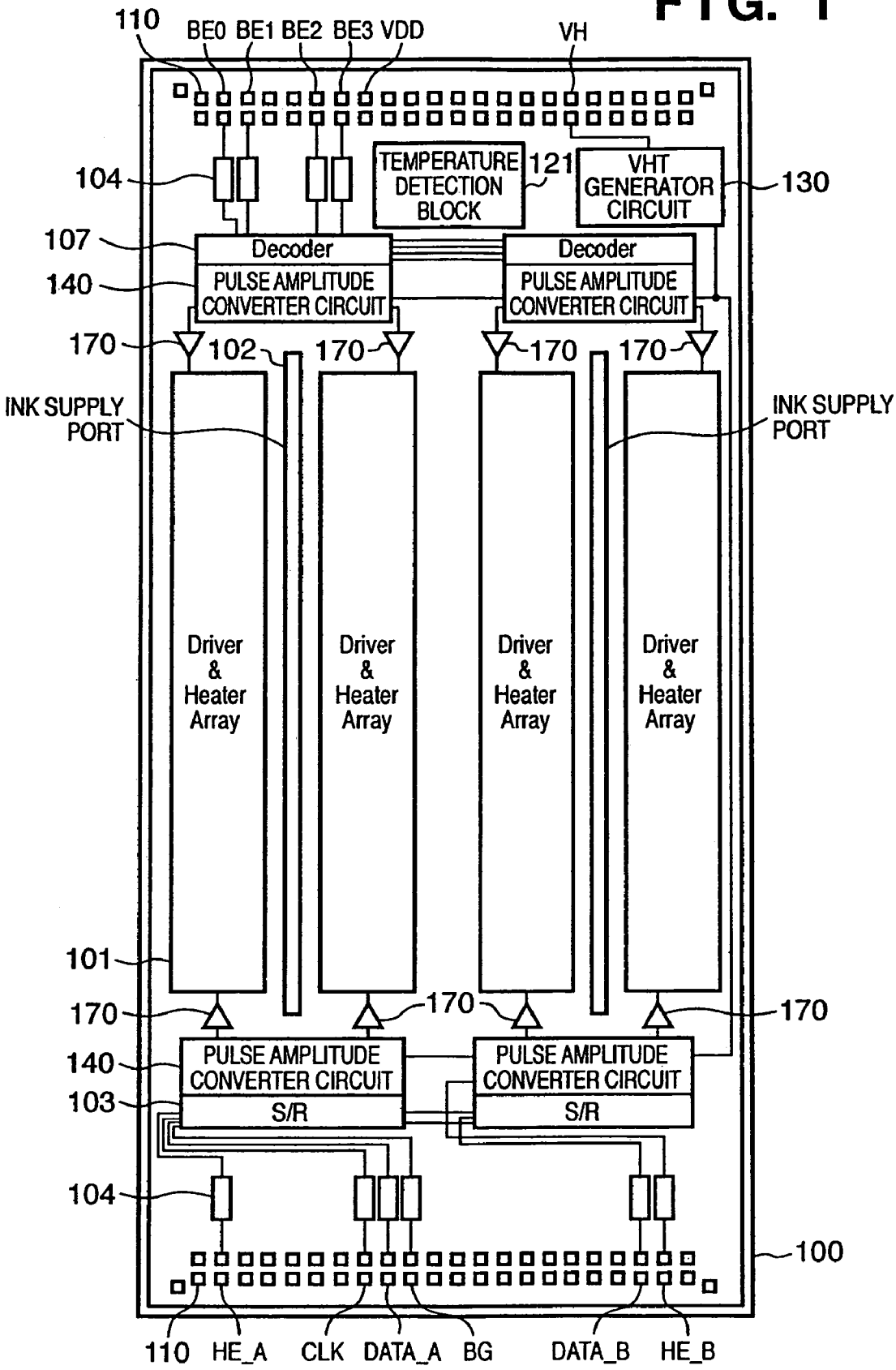
FIG. 1 is a diagram for explaining the configuration of an ink jet recording head according to Embodiment 1.

Preferred embodiments of the present invention will now be described in detail in accordance with the accompanying drawings.

In this specification, "recording" (also referred to as "printing") indicates not only formation of significant information including characters and diagrams but also indicates formation of information including images, designs, and patterns widely on a recording medium or processing of the medium, regardless whether the information is significant or not or whether the information is so evident as to be visually recognized by a person.

A "recording medium" indicates not only a paper used in a typical recording apparatus but also includes mediums capable of accepting ink. For example, fabric, a plastic film, a metal plate, glass, ceramics, wood, leather and so on are available.

Moreover, "ink" (also referred to as a "liquid") should be interpreted widely as the definition of "recording (printing)" and indicates a liquid applied to a recording medium to form an image, a design, a pattern or the like, process the recording medium, or treat ink (for example, coagulation or insolubilization of a coloring material in ink applied to the recording medium).

Further, a "nozzle" is a generic name of a discharge port, a liquid path connected to the discharge port, and a device for generating energy used for discharging ink, unless otherwise specified.

"On a device substrate" in the following explanation indicates not only "on the device substrate" but also includes a surface of the device substrate and the inner side of the device substrate near the surface. Moreover, "built-in" of the present specification does not indicate that separated devices are simply arranged on the substrate but indicates that the devices are integrally formed and manufactured on the device substrate by the manufacturing process or the like of a semiconductor circuit.

In a substrate for an ink jet recording head (hereinafter, also referred to as a head substrate) of an embodiment discussed below, the voltage conversion of pulse amplitude (FIG. 7A) is performed before an AND circuit 601. The voltage conversion has been performed immediately before the gate terminal of a driver transistor 607. That is, the voltage conversion is performed before decoder output (Block Select) and shift register output (BIT) are ANDed for each segment. Accordingly, a voltage higher than a logic voltage is applied to a circuit (corresponding to the AND circuit 601) in a part for ANDing for each segment. Thus, in the present embodiment, a device of this part is a transistor with a higher withstand voltage than other logical circuits such as a decoder and a shift register (S/R). With this configuration, it is possible to convert a segment selection signal, which has been inputted with a pulse having an amplitude of a VDD voltage, into a pulse having an amplitude of a VHT voltage without increasing a length in a direction perpendicular to the arrangement direction of each segment. Particularly in the configuration of the present embodiment, a pulse width is changed before an output signal from the decoder and a signal from the shift register are ANDed, thereby eliminating the need for a pulse amplitude converter circuit added for each segment. As a result, the number of pulse amplitude converter circuits can be reduced to the sum of the number of blocks for time-division driving (the number of outputs of signals from the decoder) and the number of data corresponding to each block (the number of outputs from the shift register), so that yields are improved and a circuit configuration is simplified.

Embodiment 1

Figure 10:
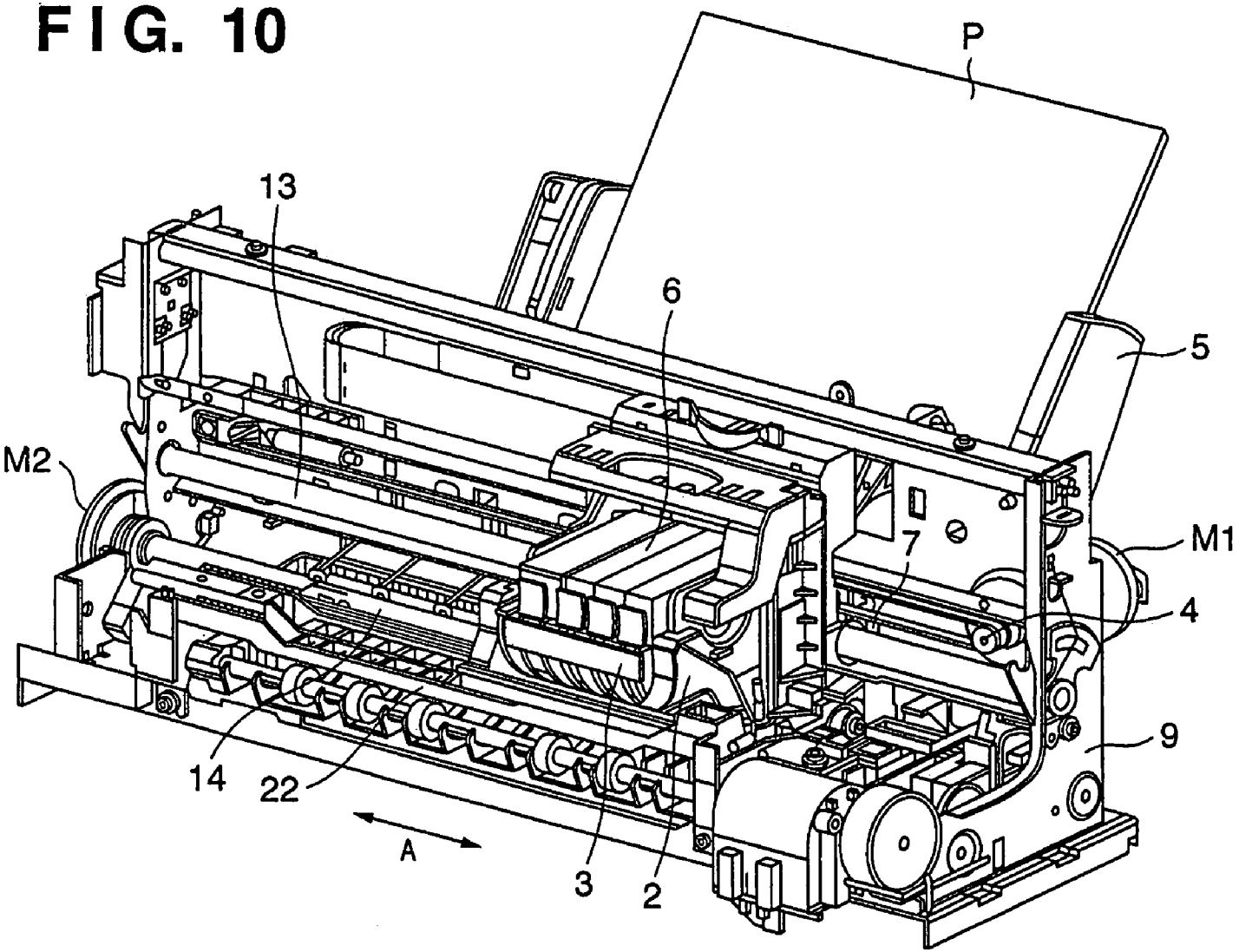
FIG. 10 is an external view showing an ink jet recording apparatus to which the present invention is applicable.

The following will first describe an example of an ink jet recording apparatus to which the present invention is applicable. FIG. 10 is an external perspective view showing the outline of the configuration of an ink jet recording apparatus 1 according to a representative embodiment of the present invention.

As shown in FIG. 10, the ink jet recording apparatus (hereinafter, referred to as a recording apparatus) has a carriage 2 in which a recording head 3 performs recording by discharging ink according to ink jet method. Driving force generated by a carriage motor M1 is transmitted to the carriage 2 through a transmission mechanism 4, and the carriage 2 is caused to reciprocate along an arrow A. Then, a recording medium P such as a recording paper is fed through a feeding mechanism 5 and carried to a recording position. Recording is performed on the recording position by discharging ink from the recording head 3 to the recording medium P.

In order to maintain preferred conditions of the recording head 3, the carriage 2 is moved to the position of a recovery device 10 and intermittently recovers discharge for the recording head 3.

The carriage 2 of the recording apparatus 1 includes not only the recording head 3 but also ink cartridges 6 for storing ink to be supplied to the recording head 3. The ink cartridges 6 can be attached and detached to and from the carriage 2.

The ink jet recording apparatus 1 of FIG. 10 is capable of color recording. For color recording, the carriage 2 has four ink cartridges for storing ink of magenta (M), cyan (C), yellow (Y), and black (K). The four ink cartridges can be attached and detached independently.

The carriage 2 and the recording head 3 have faying surfaces which are in proper contact with each other to make and keep required electrical connection. With energy applied in response to a recording signal, the recording head 3 performs recording by selectively discharging ink from a plurality of discharge ports. Particularly the recording head 3 of the present embodiment uses the ink jet method of discharging ink by means of thermal energy. Ink is discharged from the corresponding discharge port by applying a pulse voltage to an electrothermal transducer in response to a recording signal.

In FIG. 10, reference numeral 14 denotes a conveyance roller which is driven by a conveyance motor M2 to carry the recording medium P.

In the foregoing example, the recording head and the ink cartridges for storing ink can be separated from each other. However, as will be discussed below, a head cartridge in which a recording head and ink cartridges are integrated into one unit may be mounted in the carriage 2.

Figure 11:
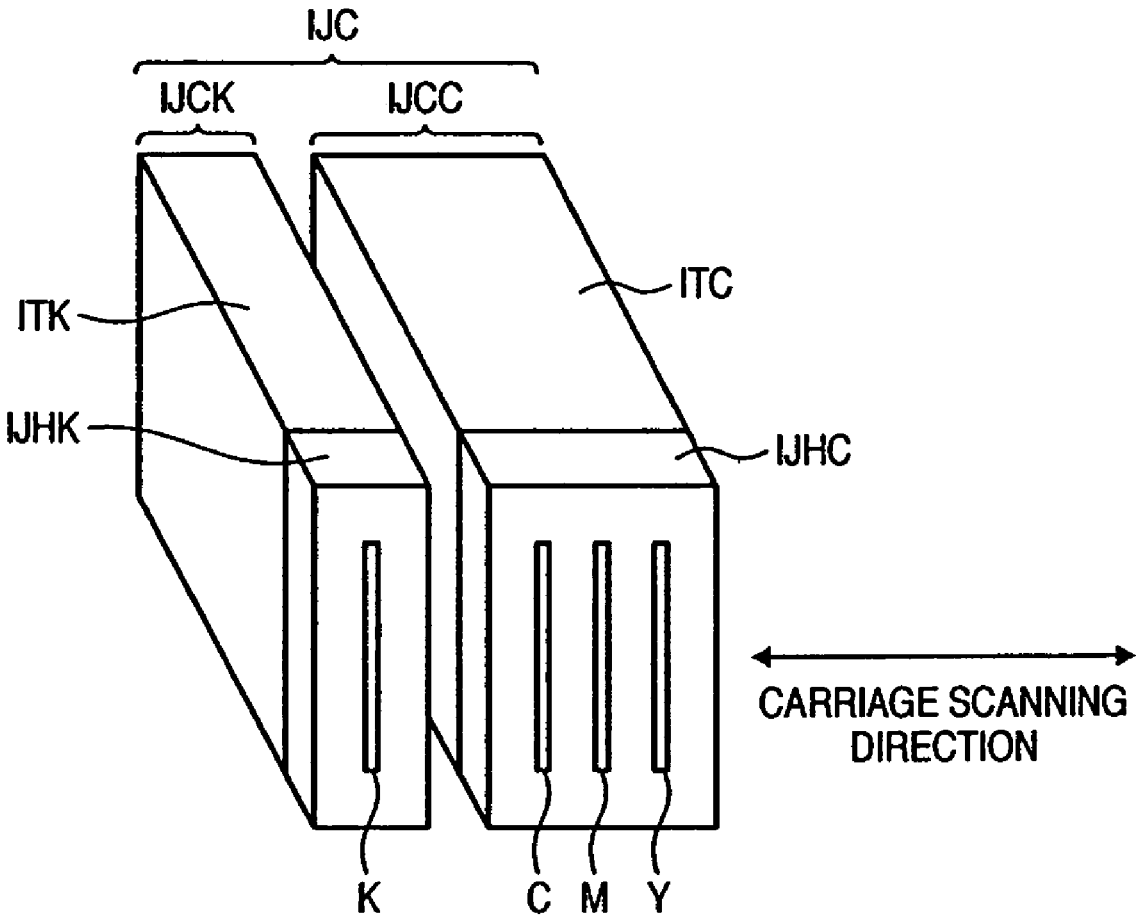
FIG. 11 is an external perspective view showing the detailed configuration of an ink jet cartridge IJC.

FIG. 11 is an external perspective view showing an example of the configuration of the head cartridge. Although the ink cartridges 6 and the recording head 3 are separated from each other in FIG. 10, the substrate for an ink jet recording head of the present invention is applicable to a head cartridge in which ink cartridges and a recording head are integrated into one unit.

As shown in FIG. 11, an ink jet cartridge IJC is constituted of a cartridge IJCK for discharging black ink and a cartridge IJCC for discharging three-color ink of C, M and Y. The two cartridges can be separated from each other and attached and detached to and from the carriage 2 independently.

The cartridge IJCK is composed of an ink tank ITK for storing black ink and a recording head IJHK for performing recording by discharging black ink. The ink tank ITK and the recording head IJHK are integrated into one unit. Similarly, the cartridge IJCC is composed of an ink tank ITC for storing three-color ink of C, M and Y and a recording head IJHC for performing recording by discharging color ink. The ink tank ITC and the recording head IJHC are integrated into one unit. In the present embodiment, the ink tank of the cartridge is filled with ink.

Further, as is evident from FIG. 11, a nozzle array for discharging black ink, a nozzle array for discharging cyan ink, a nozzle array for discharging magenta ink, and a nozzle array for discharging yellow ink are arranged along a carriage moving direction. The nozzles are arranged in a direction orthogonal to the carriage moving direction.

Figure 12:
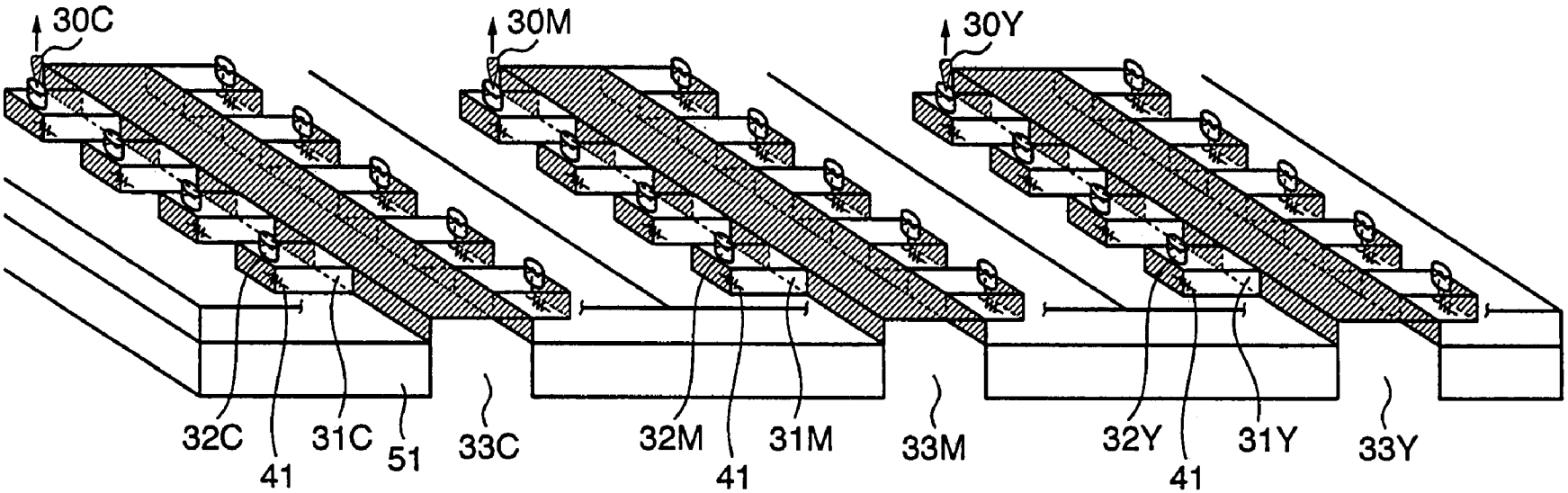
FIG. 12 is a perspective view showing the three-dimensional structure of a recording head IJHC for discharging three-color ink.

The following will discuss a head substrate used for the recording head 3 of the recording apparatus configured thus. FIG. 12 is a perspective view showing the three-dimensional structure of the recording head IJHC for discharging three-color ink.

FIG. 12 shows the flow of ink supplied from the ink tank ITC. The recording head IJHC comprises ink channels 33C, 33M, and 33Y for supplying ink of C, M and Y. Further, the ink tank ITC comprises supply paths (not shown) for supplying ink from the backside of the substrate to the respective ink channels.

After passing through the ink channels, the C, M and Y ink are guided through ink flow paths 31C, 31M and 31Y to electrothermal transducers (heaters) 41 provided on the substrate. When the electrothermal transducers (heaters) 41 are energized through circuits (described later), the ink on the electrothermal transducers (heaters) 41 is heated. The heat boils the ink, and ink droplets 30C, 30M and 30Y are discharged by bubbles from discharge ports 32C, 32M and 32Y.

In FIG. 12, reference numeral 51 denotes a head substrate in which various pads serving as electric contacts of the electrothermal transducers (described later), various circuits for driving the electrothermal transducers, memory, and a carriage HC are formed, and various signal lines are formed.

One electrothermal transducer (heater) and a MOS-FET for driving the transducer are collectively called a recording device, and a plurality of recording devices are collectively called a recording device unit.

FIG. 12 shows the three-dimensional structure of the recording head IJHC for discharging color ink. The recording head IJHK for discharging black ink has a similar structure. The structure is, however, one third as large as the configuration of FIG. 12. To be specific, only one ink channel is provided and a head substrate is about one third as large as that of FIG. 12.

Figure 13:
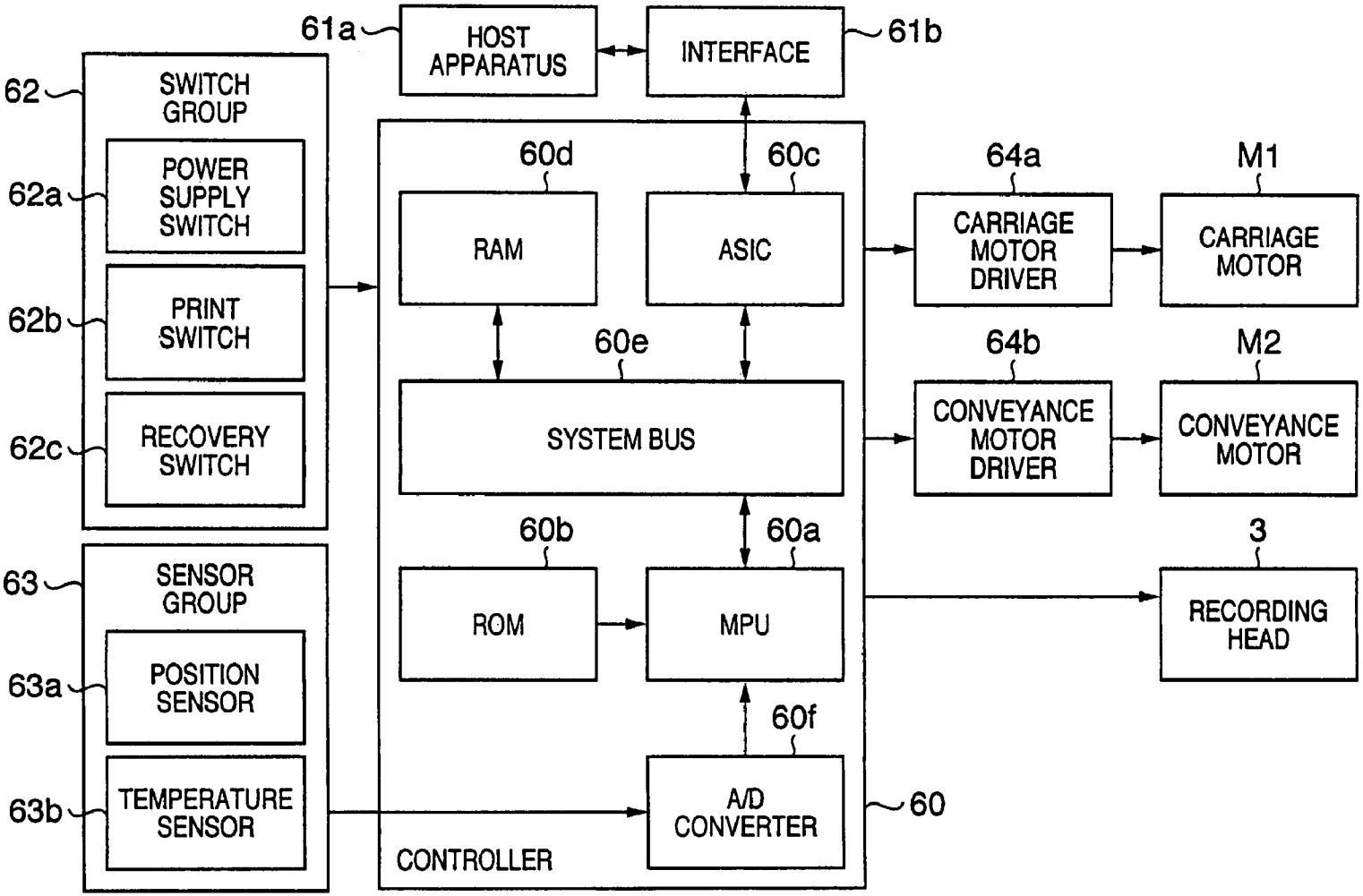
FIG. 13 is a diagram showing a control configuration for controlling the recording of the ink jet recording apparatus show in FIG. 10.

The following will discuss the control configuration of the ink jet recording apparatus. FIG. 13 is a block diagram showing the control configuration of the recording apparatus show in FIG. 10.

As shown in FIG. 13, a controller 60 comprises an MPU 60*a* and ROM 60*b* for storing programs corresponding to a control sequence (described later), a necessary table, and other fixed data. In the controller 60, an application-specific integrated circuit (ASIC) 60*c* generates control signals for controlling the carriage motor M1, the conveyance motor M2, and the recording head 3. RAM 60*d* provides an expansion area of image data and a work area for executing programs. A system bus 60*e* connects the MPU 60*a*, the ASIC 60*c*, and the RAM 60*d* to exchange data. An AD converter 60*f* is fed with analog signals from a sensor group (described later), converts the signals to digital signals, and supplies the digital signals to the MPU 60*a*.

In FIG. 13, reference character 61*a* denotes a computer (or a reader for reading images, a digital camera, and so on) which is a source of image data and is generically called a host apparatus. Image data, commands, status signals or the like are transmitted and received between the host apparatus 61*a* and the recording apparatus 1 via an interface (I/F) 61*b*.

Reference numeral 62 denotes a switch group constituted of switches for receiving command input from the operator. The switch group 62 includes, for example, a power supply switch 62*a*, a print switch 62*b* for instructing the start of printing, and a recovery switch 62*c* for instructing the start of processing (recovery) for maintaining preferred conditions of the ink discharging performance of the recording head 3. Reference numeral 63 denotes a sensor group which detects a state of the apparatus and comprises a position sensor 63*a* such as a photocoupler for detecting a home position h, a temperature sensor 63*b* provided on a proper point of the recording apparatus to detect an ambient temperature.

Reference character 64*a* denotes a carriage motor driver which drives the carriage motor M1 for causing the carriage 2 to scan along the arrow A in a reciprocating manner, and reference character 64*b* denotes a conveyance motor driver which drives the conveyance motor M2 for carrying the recording medium P.

During the recording and scanning of the recording head 3, the ASIC 60*c* transfers driving data (DATA) of the recording device (heater) to the recording head while making direct access to the storage area of the RAM 60*d*.

The following will specifically discuss the head substrate (device substrate) used for the recording head of the recording apparatus configured thus. Particularly the following will mainly discuss the configuration of the driving circuit built on the head substrate (on a heater board). As described above, the ink discharge ports 30C, 30M and 30Y corresponding to the recording devices and members (not shown) forming the flow paths 31C, 31M and 31Y connected to the ink discharge ports are provided on the head substrate. The discharge ports and the members constitute the recording head. Further, ink supplied onto the recording device is heated by driving the recording device, so that bubbles are generated by film boiling and the ink is discharged from the discharge ports.

FIG. 1 is a diagram for explaining the configuration of the device substrate of the ink jet recording head according to Embodiment 1. The device substrate of FIG. 1 constitutes a part of the recording head (IJHK, IJHC) of FIG. 11. Reference numeral 100 denotes a substrate on which the heaters and the driving circuits are integrally formed by semiconductor process technology. The substrate 100 corresponds to the substrate (reference numeral 51 of FIG. 12) for the ink jet recording head. Reference numeral 102 denotes an ink supply port (supply path) for supplying ink from the backside of the substrate. Reference numeral 101 denotes a heater/driver array where two or more heaters and driver circuits are arranged. The heater/driver array includes heaters which are electrothermal transducers for discharging ink and a driver array for selectively driving the heaters. Reference numeral 103 denotes shift registers each of which has data corresponding to one block of time-division driving for temporarily storing print data to be recorded. Reference numeral 107 denotes a decoder circuit for selecting and driving the heaters in the heater/driver array for each heater block. Reference numeral 104 denotes an input circuit which includes a buffer circuit for inputting a digital signal to the shift register 103 and the decoder 107. Reference numeral 110 denotes input terminals.

Reference numeral 130 denotes a VHT voltage generator circuit for generating, based on a heater driving power supply voltage (VH), a VHT voltage supplied to the pulse amplitude converter circuit. In this case, a voltage lower than VH is generated as the VHT voltage. Reference numeral 140 denotes a pulse amplitude converter circuit for converting a digital signal having an amplitude of a VDD voltage into the gate driving pulse of the driver transistor, the pulse having an amplitude of a VHT voltage. As shown in FIG. 1, the pulse amplitude converter circuits 140 of the present embodiment are provided on the output stage of the decoder circuit 140 and the output stage of the shift register 103, respectively. Reference numeral 170 denotes a buffer circuit which is provided for each output signal from the pulse amplitude converter circuit 140 and has a capacitance corresponding to the number of gates to which the output signal is connected in the heater/driver array 101.

Reference numeral 121 denotes a temperature detection block which includes a device for detecting the temperature of the semiconductor substrate 100. The temperature detection block 121 for detecting the temperature of the substrate was described as a device for monitoring a state of the substrate. A device for detecting the resistance of an electrothermal transducer may be provided or a device for detecting a resistance during the operation of the current driving transistor may be provided. Two or more kinds of sensing devices may be provided or may not be provided.

Figure 2:
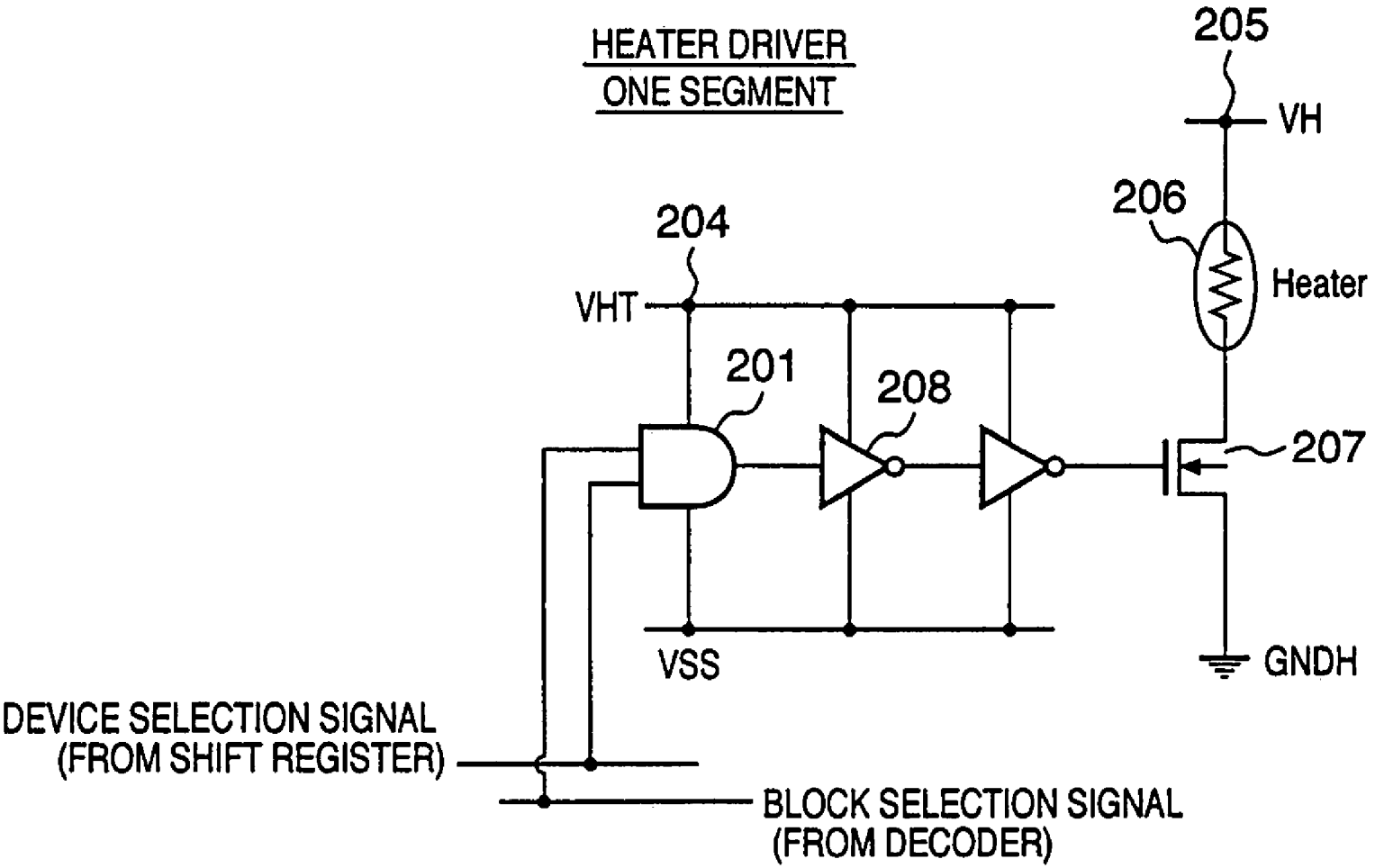
FIG. 2 is an equivalent circuit showing one segment for supplying current to a heater for discharging ink and driving the heater according to Embodiment 1.
Figure 3:
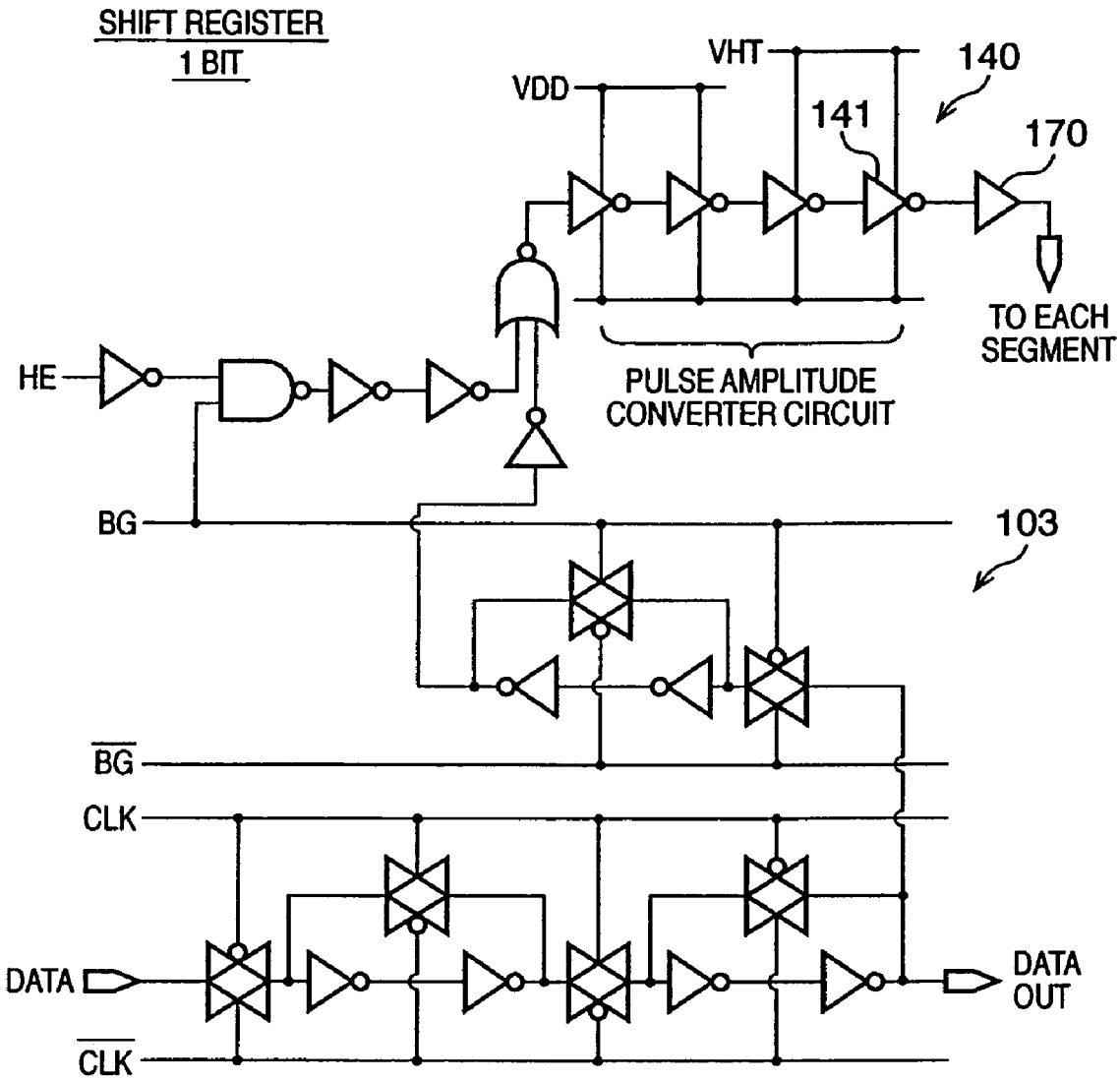
FIG. 3 is a diagram showing the configuration of a shift resistor 103 of the present embodiment.

FIG. 2 is an equivalent circuit diagram showing one segment for supplying current to the heater for discharging ink and driving the heater according to Embodiment 1. FIG. 3 is an equivalent circuit diagram corresponding to 1 bit in the shift register and a latch circuit which temporarily store image data to be printed.

Figure 6:
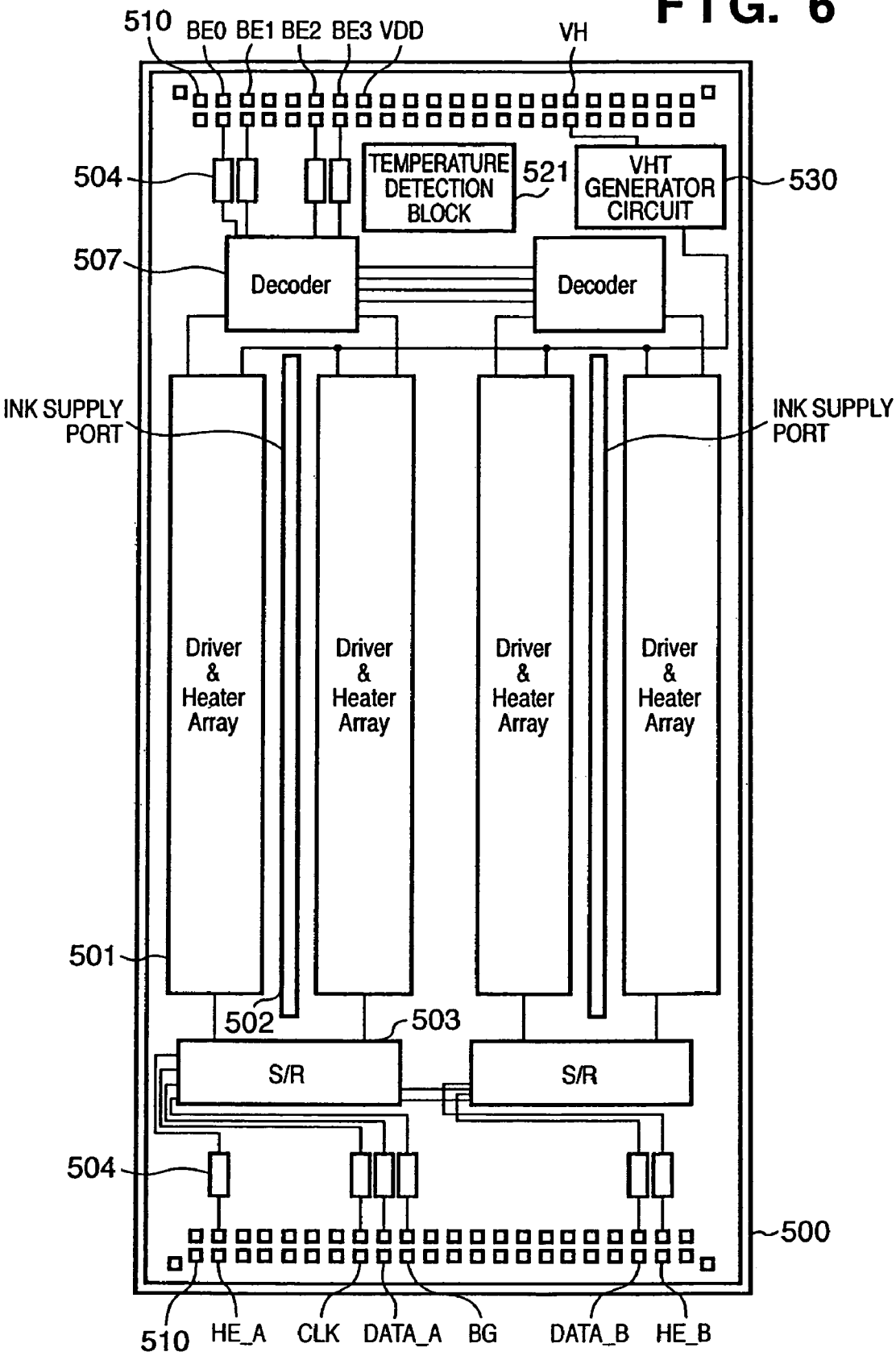
FIG. 6 is a diagram schematically showing a semiconductor substrate for a typical ink jet recording head.
Figure 7A:
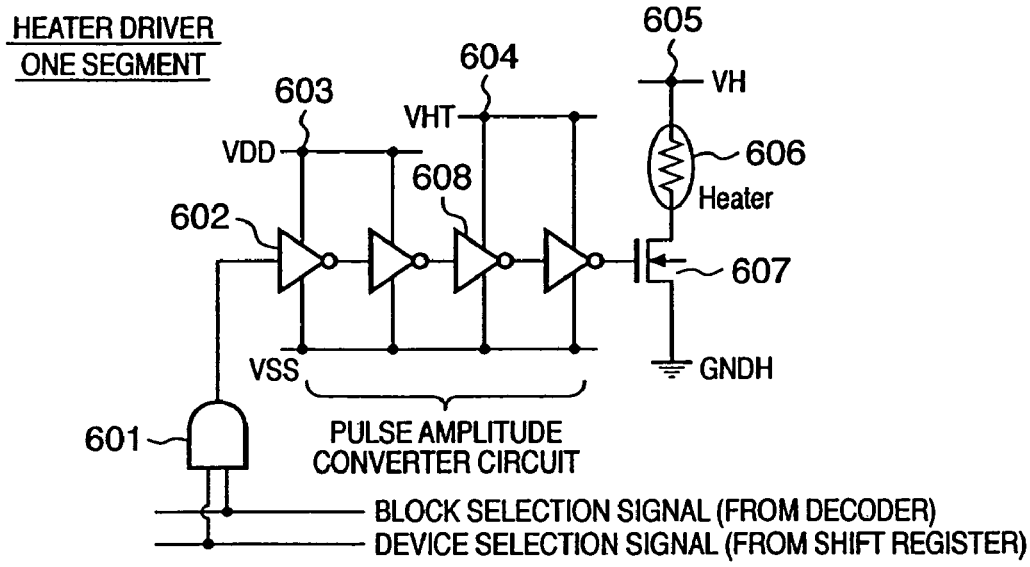
FIG. 7A is an equivalent circuit diagram showing one segment for driving current to the heater for discharging ink.

In the conventional circuit shown in FIGS. 6 and 7A, the pulse amplitude converter circuit is added to each segment (heat element for discharging ink). In contrast to the conventional circuit, as shown in FIG. 1, the pulse amplitude converter circuits are added to the output parts of the shift register 103 and the decoder 107 in the substrate 100 for the ink jet recording head of the present embodiment. In other words, a pulse amplitude voltage is set high before the output signal (block selection signal) of the decoder circuit 107 and the output signal (device selection signal) of the shift register circuit 103 are ANDed (before the completion of the final logical operation). Thus, as shown in FIG. 2, each segment is fed with a pulse whose amplitude has increased to the VHT voltage. Since each segment does not require any converter circuits, a device area corresponding to the converter circuit is unnecessary.

In this case, a high voltage is applied to the AND circuit 201 for performing an AND operation in each segment, and thus transistors constituting the circuit have to be devices with higher withstanding voltage. In the conventional circuit, only a low voltage corresponding to a logic voltage is applied to this part, and thus this part is constituted of devices with low withstand voltages. In the present embodiment, this part has a higher withstand voltage than transistors constituting other logical circuits. To be specific, transistors constituting the AND circuit are high withstand voltage devices.

In the case of such high withstand voltage transistors (MOS transistors), the transistors are larger in size than low withstand voltage transistors. However, as will be discussed later, the number of pulse amplitude converter circuits (level converters) can be reduced and the pulse amplitude converter circuits can be disposed away from the segments. Thus, it is possible to reduce the overall size of the substrate 100 for the ink jet recording head.

Figure 7B:
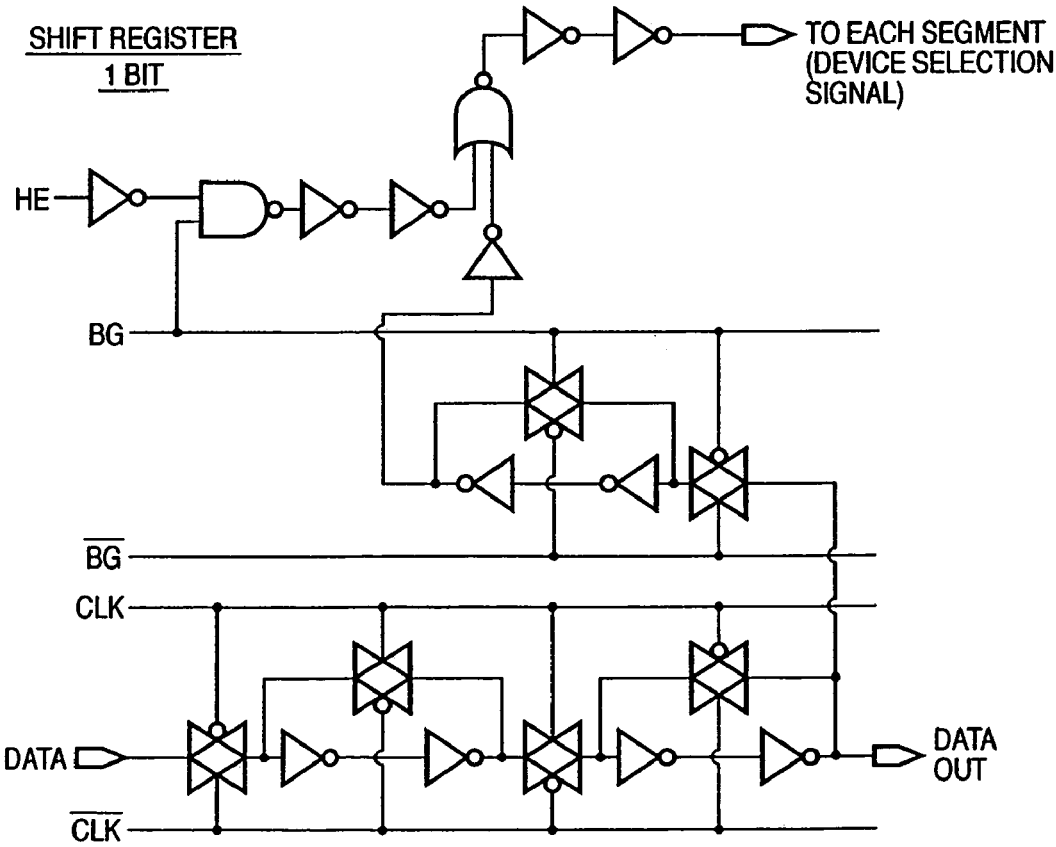
FIG. 7B is an equivalent circuit diagram corresponding to 1 bit in the shift register and a latch circuit which temporarily store image data to be printed.
Figure 8:
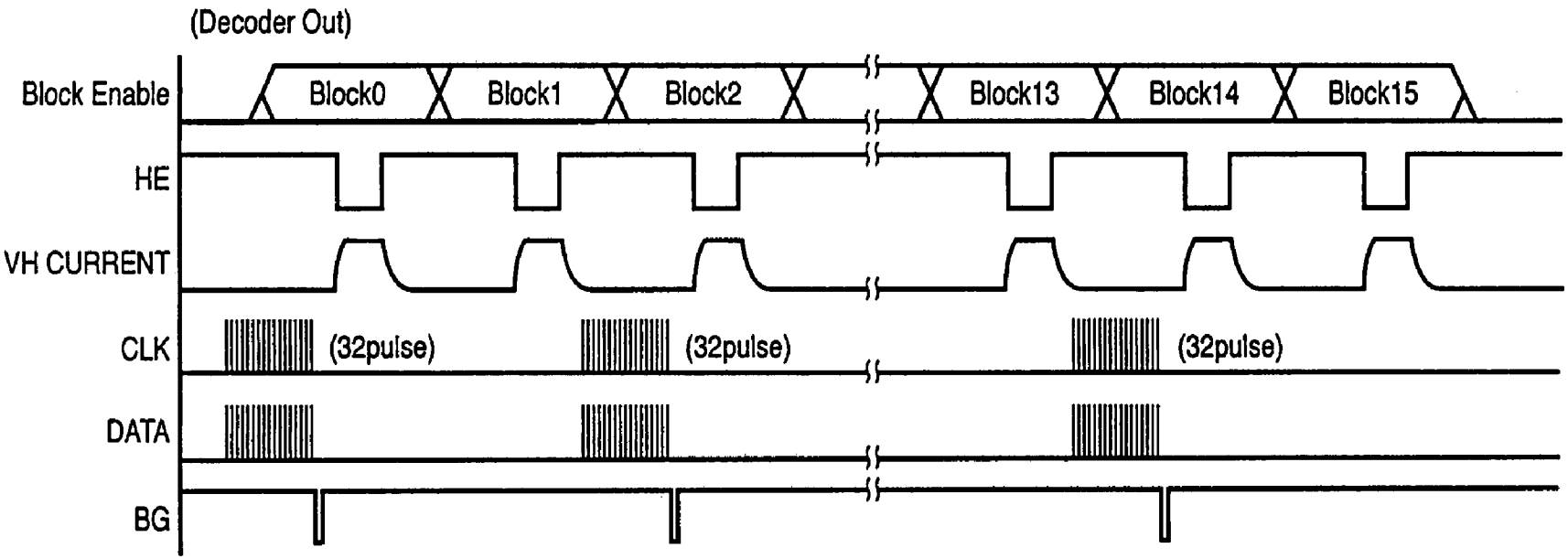
FIG. 8 is a timing chart for explaining a series of operations of the transmission of print information to a shift register 503, the supply of current to the heater, and the driving of the heater.
Figure 9:
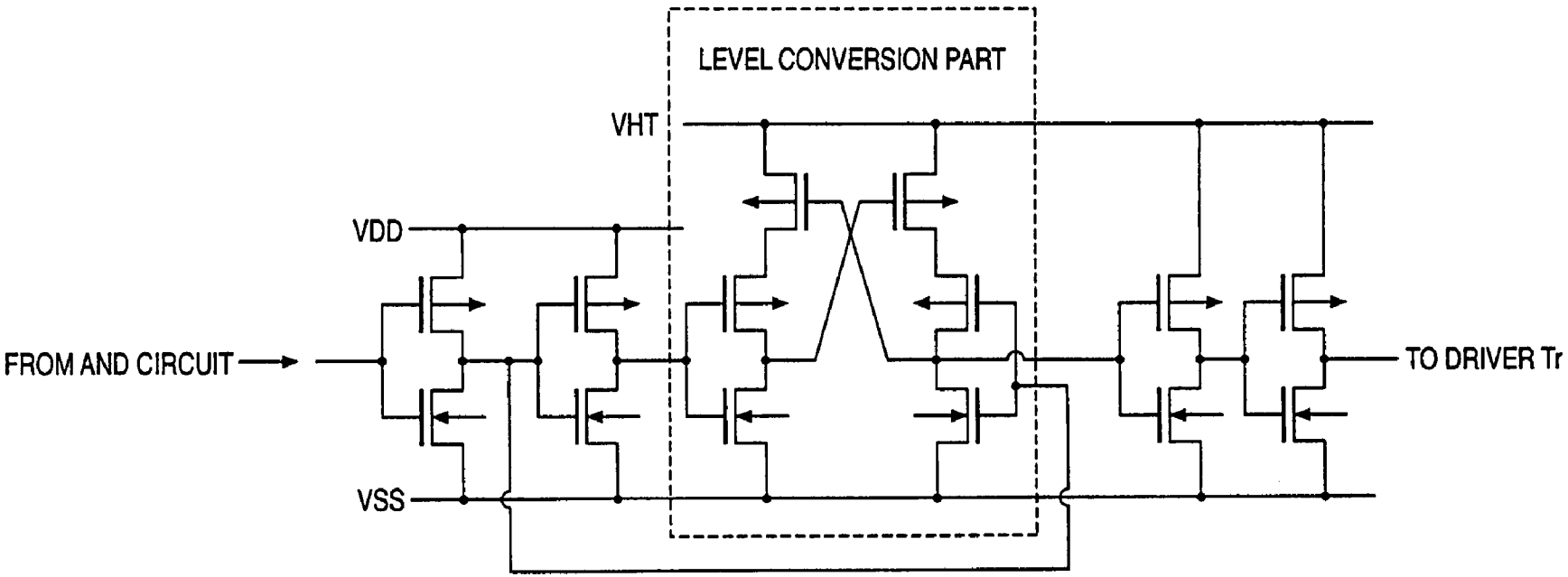
FIG. 9 is a diagram showing an equivalent circuit of a pulse amplitude converter circuit.

FIG. 3 is a diagram showing the configuration of the shift resistor 103 and the pulse amplitude converter circuit 140 according to the present embodiment. Unlike the circuit configuration of the shift register shown in FIG. 7B, the pulse amplitude converter circuit is added to an output stage where the amplitude of a pulse is converted from the VDD voltage to the VHT voltage, which is a higher voltage amplitude.

The number of output stages of the shift register 103 and the decoder circuit 107 is determined by the number of divisions when all the segments are driven in a time sharing manner. In this case, about 8 to 32 divisions are obtained. For example, when 256 segments are divided by 16 (each block has 16 segments), the necessary number of pulse amplitude converter circuits is 16×2 (shift register side and decoder side)=32. This is a considerable reduction as compared with 256 circuits obtained by adding the pulse amplitude converter circuits to all the segments. Thus, it is possible to reduce a chip length (the length of the device substrate) in a direction perpendicular to the arrangement direction of the segments. The pulse amplitude converter circuits added to the shift register 103 and the decoder circuit 107 increase a chip length in the arrangement direction. However, the increase in length of the chip is small relative to the reduction in length along the perpendicular direction, so that the overall chip area is reduced.

Figure 4:
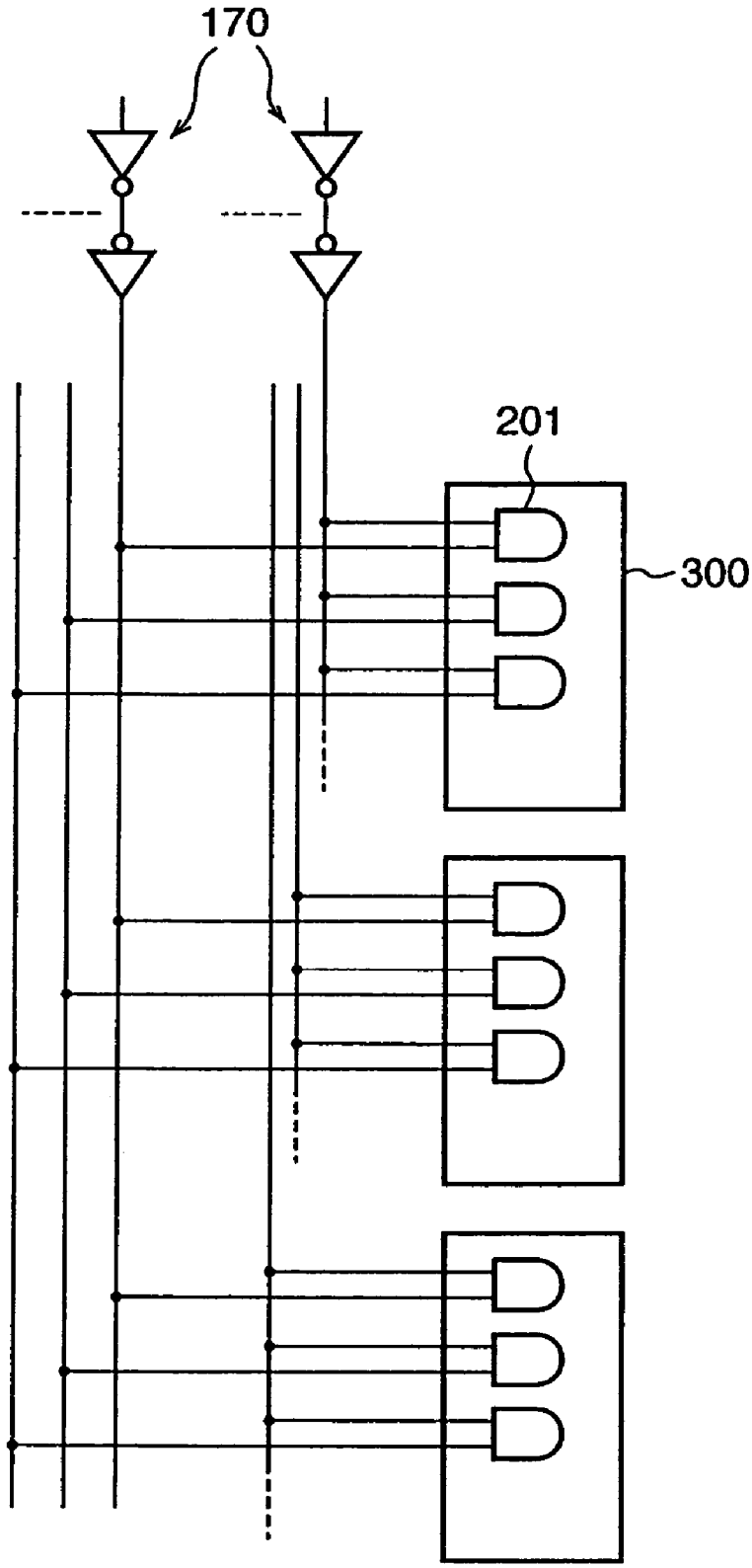
FIG. 4 is a diagram for explaining the connection of a block selection signal, a device driving signal, and each driving block.

Further, as shown in FIG. 1, a buffer 170 for adjusting a load is connected to the output of the pulse amplitude converter circuit 140. To be specific, the buffer 170 is constituted of two inverters. As shown in FIG. 3, the buffer 170 is provided in the output stage of the pulse amplitude converter circuit for each signal line. As shown in FIG. 4, the buffer 170 of the block selection signal and the buffer 170 of the device selection signal are both connected to a plurality of AND gates.

The gate electrodes of the AND circuits provided for the segments are all hung as capacitive loads on the outputs of the pulse amplitude converter circuits 140. For example, as shown in FIG. 4, one block selection signal is inputted to all AND gates 201 corresponding to segments in one driving block 300. In other words, the gate electrodes of the AND circuits corresponding to the number of segments in one driving block are hung as capacitive loads on each block selection signal. One device selection signal is connected to one AND gate of each driving block. In other words, the gate electrodes of the AND circuits corresponding to the total number of driving blocks are hung as capacitive loads on each device selection signal. Therefore, as compared with the configuration of FIG. 7A in which one gate electrode is connected to one pulse amplitude converter circuit, a waveform after pulse amplitude conversion may be rounded by a CR time constant. Particularly when a logic operation is performed at a high voltage as in the present embodiment and in the case of a head having a number of segments, a CR time constant greatly affects a waveform.

When pulse edges are rounded, only a pulse shorter than a desired pulse width (time) can be applied, so that a desired ink discharging property cannot be obtained. The buffer 170 is a buffer circuit for adjustment and is added to solve this problem. The size of the buffer circuit is set with sufficient driving force for a capacitance corresponding to the number of segments (the circuit built in the semiconductor substrate is increased in size), so that rounding of pulse edges can be reduced and the heaters can be more ideally driven. The buffer circuit 170 has the following conditions:

(a) The necessary number of gates can be all driven by a pulse signal which keeps a predetermined rising/falling property (velocity), (b) An increase in area on the substrate according to an increase in capacitance of a device (inverter) is limited within predetermined tolerance.

For example, when 256 nozzles are divided by 16 blocks and driven, the number of necessary gates is 16. That is, gates as many as the number of divided blocks are driven. An area increase caused by the inverters can be sufficiently absorbed as compared with an area increase in the direction perpendicular to the arrangement direction of the segments. This is because the converter circuits are disposed on the end of the chip. According to the circuit arrangement of the present embodiment, a buffer circuit having sufficient current supply capability (capacitance) can be provided within the tolerance of an area increase.

Figure 14:
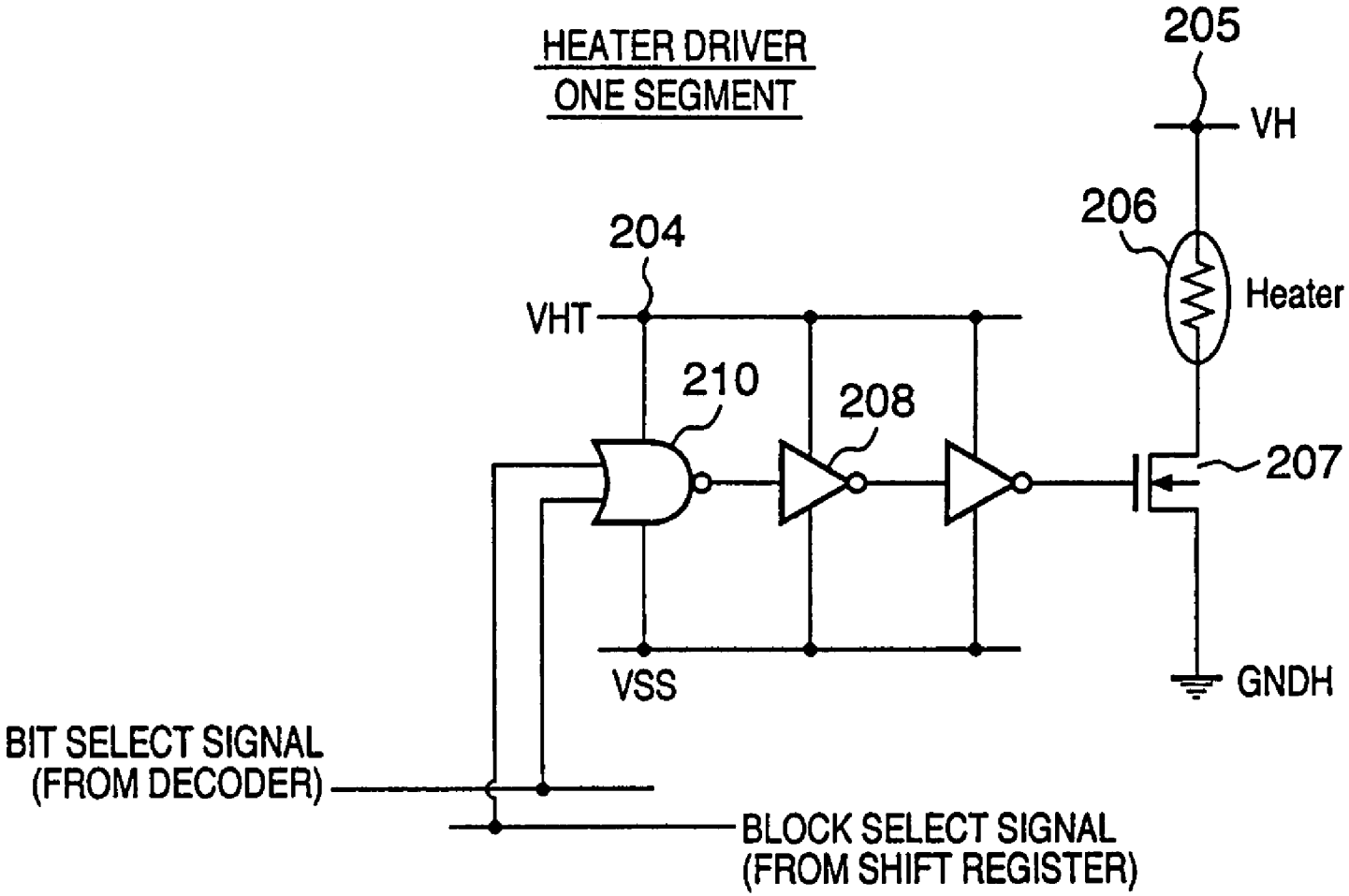
FIG. 14 is a diagram showing an example in which an AND gate 201 is replaced with a NOR gate in the circuit configuration of FIG. 2.

In the foregoing embodiment, the buffer 170 is constituted of two inverters but the number of inverters is not limited. For example, the buffer 170 may comprise one inverter and the AND gate 201 of FIG. 2 may be replaced with a NOR gate. FIG. 14 shows that a NOR gate 210 is used instead of the AND gate 201. Further, for example, the inverter 141 in the final stage of the pulse amplitude converter circuit 140 of FIG. 3 may have a capacitance with an adjustable load and the buffer 170 may be omitted.

Embodiment 2

Figure 5:
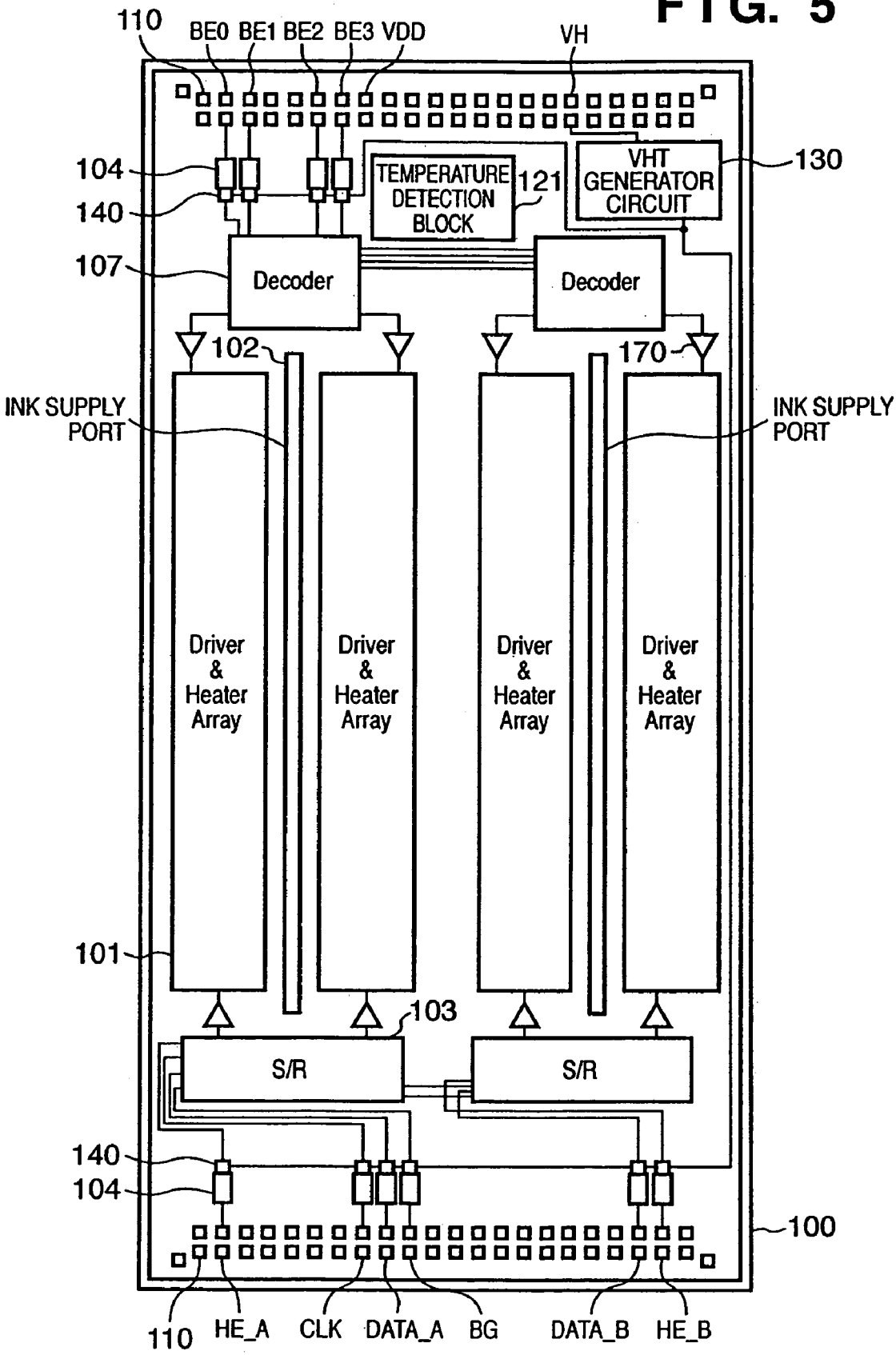
FIG. 5 is a diagram for explaining a substrate for an ink jet recording head according to Embodiment 2.

FIG. 5 is a diagram for explaining a device substrate for an ink jet recording head according to Embodiment 2. In FIG. 5, the same configurations as FIG. 1 are indicated by the same reference numerals and the detailed explanation thereof is omitted.

In Embodiment 2, pulse amplitude converter circuits 140 are inserted immediately after input circuits 104. This embodiment only requires pulse amplitude converter circuits as many as input terminals (logic input terminals of CLK, DATA_A, DATA_B, BG, HE_A, HE_B), thereby further reducing a chip size.

As in Embodiment 1, buffers 170 are connected to the previous stages of driving circuits (heater/driver arrays 101), so that a velocity at a rising edge and a falling edge of a pulse is maintained.

As described above, according to the foregoing embodiments, the voltage conversion of pulse amplitude is performed before the output of the decoder and the output of the shift register are ANDed, unlike the conventional art in which voltage conversion is performed immediately before the gate terminal of a driver transistor. With this configuration, it is possible to convert a segment selection signal, which has been inputted as a pulse having an amplitude of the VDD voltage, into a pulse having an amplitude of the VHT voltage without increasing a length in the direction perpendicular to the arrangement direction of each segment.

Further, it is possible to achieve a circuit configuration which makes it possible to considerably reduce the number of pulse amplitude converter circuits added to each segment. Therefore, it can be expected that a chip size will be reduced, yields will be improved by a smaller number of elements, and the cost will be reduced by a simple circuit configuration. Moreover, the buffers 170 are inserted in the previous stage of the driving circuits for driving the heaters in response to the block selection signal and the device driving circuit, thereby preventing rounding of pulse edges and degradation of print quality.

According to the present invention, it is possible to provide a circuit configuration for converting a logic driving voltage to a device driving voltage without increasing a length in the direction perpendicular to the arrangement direction of each segment. Further, according to the present invention, the number of pulse amplitude converter circuits is reduced and the number of devices formed on the substrate is reduced, so that yields can be improved and the circuit configuration can be simplified.

As many apparently widely different embodiments of the present invention can be made without departing from the spirit and scope thereof, it is to be understood that the invention is not limited to the specific embodiments thereof except as defined in the appended claims.

CLAIM OF PRIORITY

This application claims priority from Japanese Patent Application No. 2004-357185 filed on Dec. 9, 2004, which is hereby incorporated by reference herein.

What is claimed is:

1. A substrate for an ink jet recording head, the substrate provided with electrothermal transducers for generating thermal energy used for discharging ink and a driving circuit for driving the electrothermal transducers, the substrate comprising:

a logic circuit for outputting, at a second voltage amplitude level based on an input signal of a first voltage amplitude level, selection signals for designating the electrothermal transducers to be driven, wherein the second voltage amplitude level is higher than the first voltage amplitude level, and the selection signals comprise block selection signals and device selection signals so as to time-divisionally drive the electrothermal transducers in units of blocks and each of the block selection signals is commonly used for driving of electrothermal transducers in one block, a gate circuit for inputting the selection signals of the second voltage amplitude level from the logic circuit and outputting driving signals of the second voltage amplitude level, each of which corresponds to each of the electrothermal transducers, a driving circuit for driving the electrothermal transducers based on the driving signals from the gate circuit, and a buffer circuit which has current supply capability of driving all gates fed with one block selection signal in the driving circuit and relays the selection signals between the logic circuit and the driving circuit, wherein the gate circuit includes a plurality of AND gate circuits in each driving block, and each of the AND gate circuits inputs one of the block selection signals of the second voltage amplitude level and one of the device selection signals of the second voltage amplitude level.

2. The substrate according to claim 1, wherein the logic circuit generates the selection signals by using the input signal of the first voltage amplitude level, converts the selection signals of the first voltage amplitude level into the selection signals of the second voltage amplitude level, and outputs the converted selection signals.

3. The substrate according to claim 1, wherein the logic circuit converts the input signal of the first voltage amplitude level into a signal of the second voltage amplitude level, generates the selection signals by using the converted signal, and outputs the selection signal.

4. The substrate according to claim 1, wherein the logic circuit includes an inverter circuit in a final stage, and the inverter circuit of the final stage also serves as the buffer circuit.

5. A recording head using the substrate for the ink jet recording head according to claim 1.

6. The recording head according to claim 5, wherein the recording head is an ink jet recording head which discharges ink to perform recording.

7. A head cartridge comprising:

the ink jet recording head according to claim 6, and an ink tank for storing ink to be supplied to the ink jet recording head.

8. A recording apparatus comprising the head cartridge according to claim 7, wherein the recording apparatus performs recording using the cartridge.

9. A recording apparatus comprising the recording head according to claim 5, wherein the recording apparatus performs recording using the recording head.

10. The substrate according to claim 1, wherein one device selection signal is connected to one AND gate circuit of each driving block.

* * * * *